US010128598B2

(12) United States Patent
Ishii et al.

(10) Patent No.: US 10,128,598 B2
(45) Date of Patent: Nov. 13, 2018

(54) CONNECTOR AND CONNECTOR ASSEMBLY

(71) Applicant: Molex, LLC, Lisle, IL (US)

(72) Inventors: Akihiro Ishii, Yamato (JP); Yoshiteru Nogawa, Yamato (JP); Kazuya Takahashi, Yamato (JP)

(73) Assignee: Molex, LLC, Lisle, IL (US)

( * ) Notice: Subject to any disclaimer, the term of this patent is extended or adjusted under 35 U.S.C. 154(b) by 87 days.

(21) Appl. No.: 15/088,975

(22) Filed: Apr. 1, 2016

(65) Prior Publication Data

US 2017/0040725 A1 Feb. 9, 2017

(30) Foreign Application Priority Data

Aug. 6, 2015 (JP) ..... 2015-156502

(51) Int. Cl.
*H01R 12/77* (2011.01)
*H01R 13/631* (2006.01)

(52) U.S. Cl.
CPC ..... *H01R 12/771* (2013.01); *H01R 12/774* (2013.01); *H01R 13/631* (2013.01)

(58) Field of Classification Search
CPC ... H01R 12/774; H01R 12/771; H01R 13/631
See application file for complete search history.

(56) References Cited

U.S. PATENT DOCUMENTS

| | | | | |
|---|---|---|---|---|
| 4,740,867 | A * | 4/1988 | Roberts | H01R 12/79 361/749 |
| 5,584,719 | A | 12/1996 | Tsuji et al. | |
| 6,086,412 | A | 7/2000 | Watt et al. | |
| 6,755,683 | B2 * | 6/2004 | Roberts | H01R 12/79 439/496 |
| 6,808,412 | B2 | 10/2004 | Ishii | |
| 8,840,415 | B2 * | 9/2014 | Orris | H01R 12/592 439/329 |
| 2003/0194899 | A1 * | 10/2003 | Ueda | H01R 13/6272 439/357 |
| 2004/0002255 | A1 * | 1/2004 | Ueda | H01R 12/79 439/495 |
| 2017/0040725 | A1 | 2/2017 | Ishii et al. | |

FOREIGN PATENT DOCUMENTS

| | | | |
|---|---|---|---|
| JP | 02-112180 | A | 4/1990 |
| JP | 04-147583 | A | 5/1992 |
| JP | 05-205830 | A | 8/1993 |
| JP | 2002-100425 | A | 4/2002 |

(Continued)

*Primary Examiner* — Briggitte R Hammond
(74) *Attorney, Agent, or Firm* — James A. O'Malley

(57) ABSTRACT

A connector is provided which includes a stage having an arrangement surface for arranging the end portion of the flat cable, and an opposing portion formed so as to face the arrangement surface. An engaging protruding portion is formed in the arrangement surface for engaging the flat cable. The end portion of the flat cable is insertable from the front side to the rear side of the connector between the arrangement surface and the opposing portion. The opposing portion has an extending portion positioned in front of the engaging protruding portion, and an overhanging portion extending to the rear of a first section.

18 Claims, 8 Drawing Sheets

(56) References Cited

FOREIGN PATENT DOCUMENTS

| | | | |
|---|---|---|---|
| JP | 2002-100426 | A | 4/2002 |
| JP | 2008-300129 | A | 12/2008 |
| JP | 4750395 | B2 | 8/2011 |
| TW | 201345073 | A | 1/2013 |
| TW | I473364 | B | 11/2015 |

* cited by examiner

CONNECTOR AND CONNECTOR ASSEMBLY

RELATED APPLICATIONS

This application claims priority to Japanese Application No. 2015-156502, filed Aug. 6, 2015, which is incorporated herein by reference in its entirety.

TECHNICAL FIELD

The present disclosure relates to a connector and a connector assembly.

BACKGROUND ART

A connector mounted on the end portion of a flat cable has been disclosed in Patent Document 1. The connector in Patent Document 1 is mated with another connector mounted on a printed circuit board to establish an electrical connection between the flat cable and the circuit board. The connector in Patent Document 1 has a flat panel portion on which the end portion of the flat cable is arranged, and a cable guide piece facing the flat panel portion across a gap. Engaging projections are formed on the flat panel portion. The flat cable is inserted between the flat panel portion and the cable guide piece, and the engaging projections on the flat panel portion are fitted into holes in the flat cable. The engaging projections keep the flat cable from becoming detached from the connector.

Patent Document 1: Laid-Open Patent Publication No. 2002-100425

SUMMARY

In the connector of Patent 1, a rod-shaped cable guide piece extends in the left-right direction, and the engaging projections are positioned away from the cable guide piece in the insertion direction of the flat cable. Therefore, when the flat cable is bent and moved, the end portion of the flat cable may rise off the flat panel portion and the holes in the flat cable may become detached from the engaging projections.

The present disclosure provides a connector able to improve the mounting stability to a flat cable.

The present disclosure is a connector mounted on the end portion of a flat cable, the connector comprising: a stage having an arrangement surface for arranging the end portion of the flat cable; an engaging protruding portion formed on the arrangement surface for engaging the flat cable; and an opposing portion formed so as to face the arrangement surface; the end portion of the flat cable being insertable from the front side to the rear side of the connector between the arrangement surface and the opposing portion, and the opposing portion having a first section arranged in front of the engaging protruding portion and a second section extending to the rear from the first section. Because the distance between the engaging protruding portion and the opposing portion in the insertion direction of the flat cable can be reduced by the second section, the mounting stability of the connector to a flat cable can be improved.

In one aspect of the present disclosure, the connector includes two side wall portions positioned on opposite sides from each other in the left-right direction to interpose the arrangement surface, the first section having a connecting portion extending in the left-right direction and connecting to at least one of the two side wall portions, the first section having a section positioned in front of the connecting portion, and the second section extending to the rear of the connecting portion of the first section.

In one aspect of the present disclosure, the connector includes two side wall portions positioned on opposite sides from each other in the left-right direction to interpose the arrangement surface, the first section having a connecting portion connecting to at least one of the two side wall portions, and the opposing portion of the connector being elastically deformable so the second section moves vertically around the connecting portion.

In one aspect of the present disclosure, the second section is positioned to the left or the right of the engaging protruding portion.

In one aspect of the present disclosure, the leading end of the second section is positioned to the rear of the engaging protruding portion.

In one aspect of the present disclosure, the engaging protruding portion is formed in the end portion of the arrangement surface in the left-right direction.

In one aspect of the present disclosure, the connector includes two side wall portions positioned on opposite sides from each other in the left-right direction to interpose the arrangement surface, the first section spanning the two side wall portion, and the second section extending to the rear from the central portion of the first section.

In one aspect of the present disclosure, the engaging protruding portion has a first surface facing the direction away from the arrangement surface, the second section of the opposing portion has a second surface facing the arrangement surface, and the height from the first surface of the engaging protruding portion to the arrangement surface is greater than the distance from the first surface of the engaging protruding portion to the second surface of the second section.

In one aspect of the present disclosure, a guide portion is formed so as to face the arrangement surface and positioned to the rear of the engaging protruding portion, the edge of the flat cable being arrangeable between the arrangement surface and the guide portion.

The present disclosure is also a connector assembly comprising a second connector having an opening in the front and a plurality of terminals arranged inside and a first connector inserted into the second connector mounted on the end portion of a flat cable, the first connector including a stage having an arrangement surface for arranging the end portion of the flat cable; an engaging protruding portion formed on the arrangement surface for engaging the flat cable; and an opposing portion formed so as to face the arrangement surface; the end portion of the flat cable being insertable from the front side to the rear side of the connector between the arrangement surface and the opposing portion, and the opposing portion having a first section arranged in front of the engaging protruding portion and a second section extending to the rear from the first section.

DETAILED DESCRIPTION OF THE PREFERRED EMBODIMENTS

Figure 1:
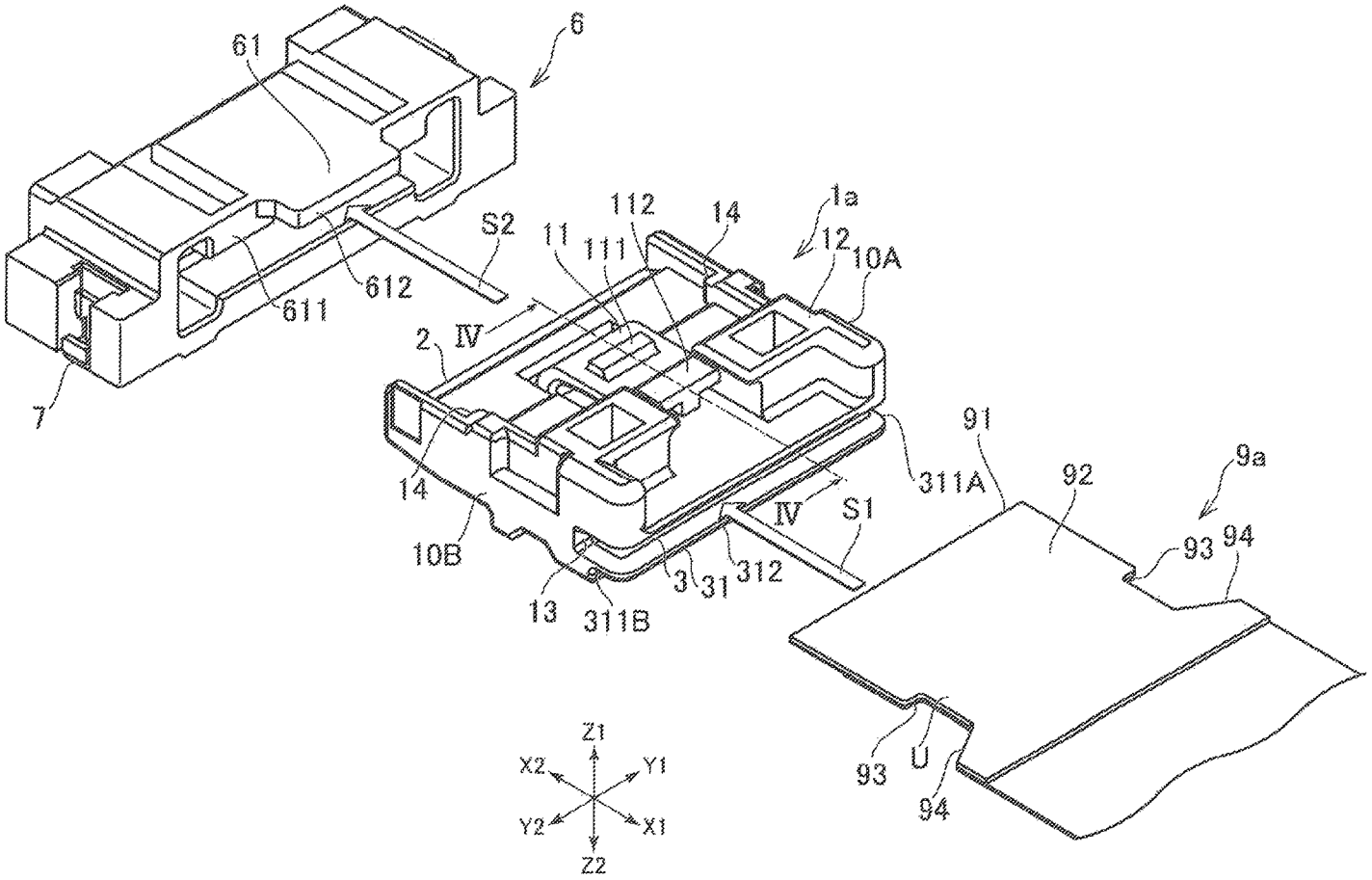
FIG. 1 is a perspective view from above showing the first connector, the second connector, and the flat cable in the first embodiment of the present disclosure.
Figure 2:
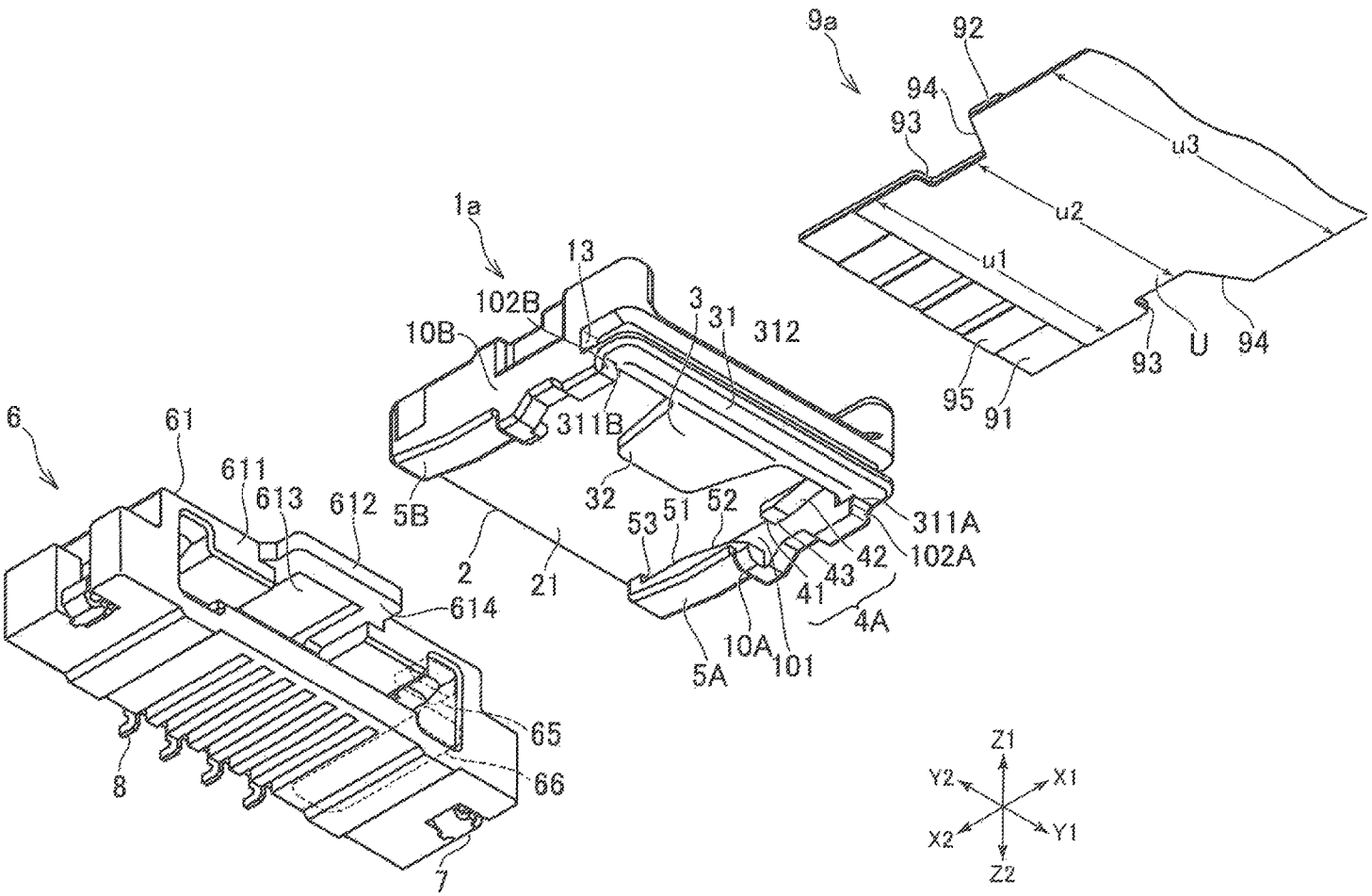
FIG. 2 is a perspective view from below showing the first connector, the second connector, and the flat cable in the same embodiment.
Figure 3:
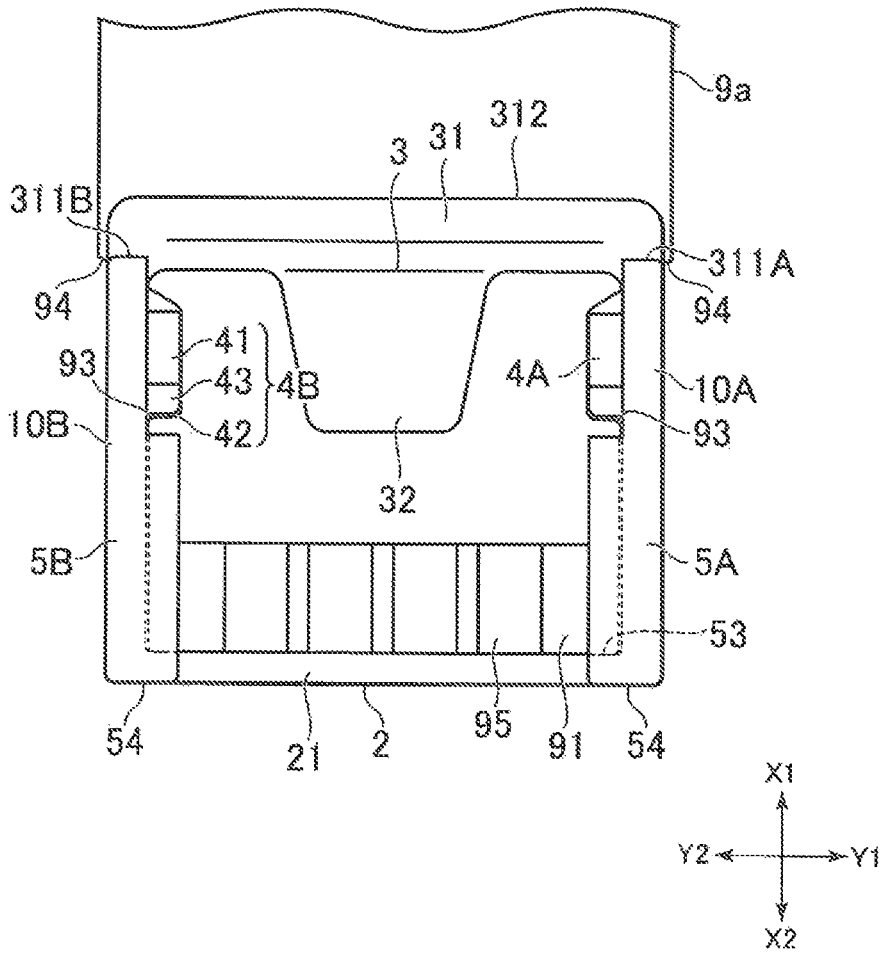
FIG. 3 is a bottom view showing the flat cable inserted into the first connector.
Figure 4A:
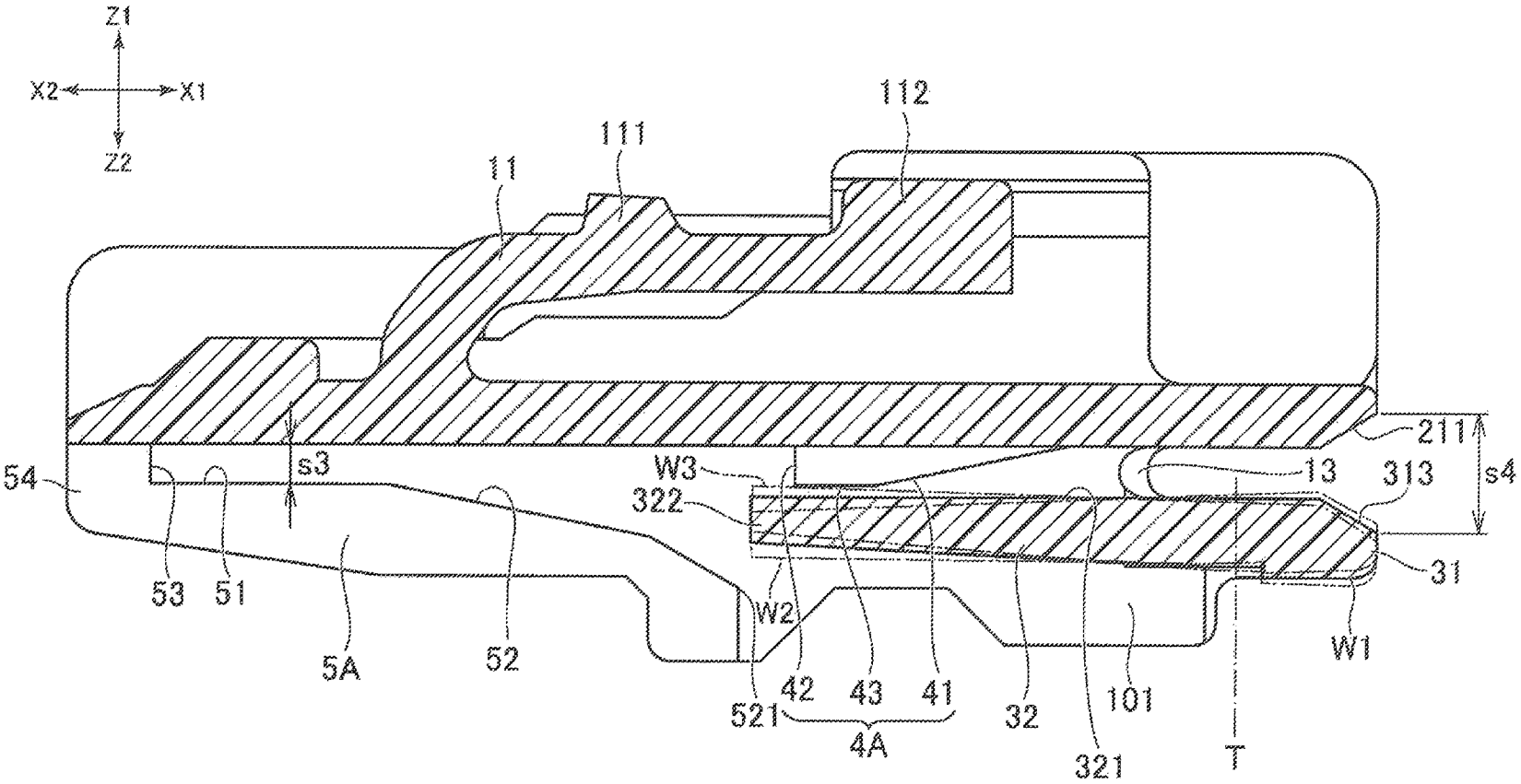
FIG. 4A is a cross-sectional view from line IV-IV in FIG. 1.
Figure 4B:
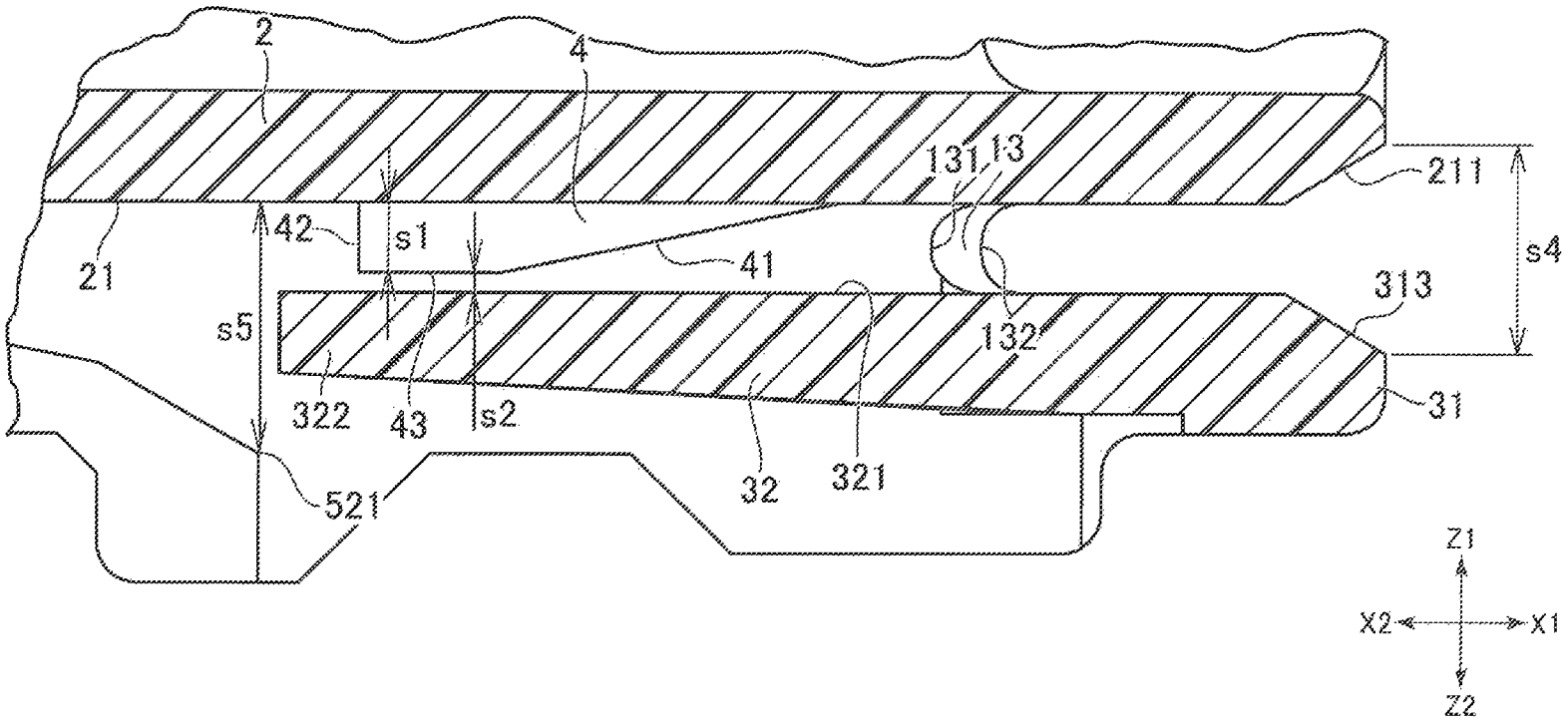
FIG. 4B is an enlarged cross-sectional view of FIG. 4A.
Figure 5A:
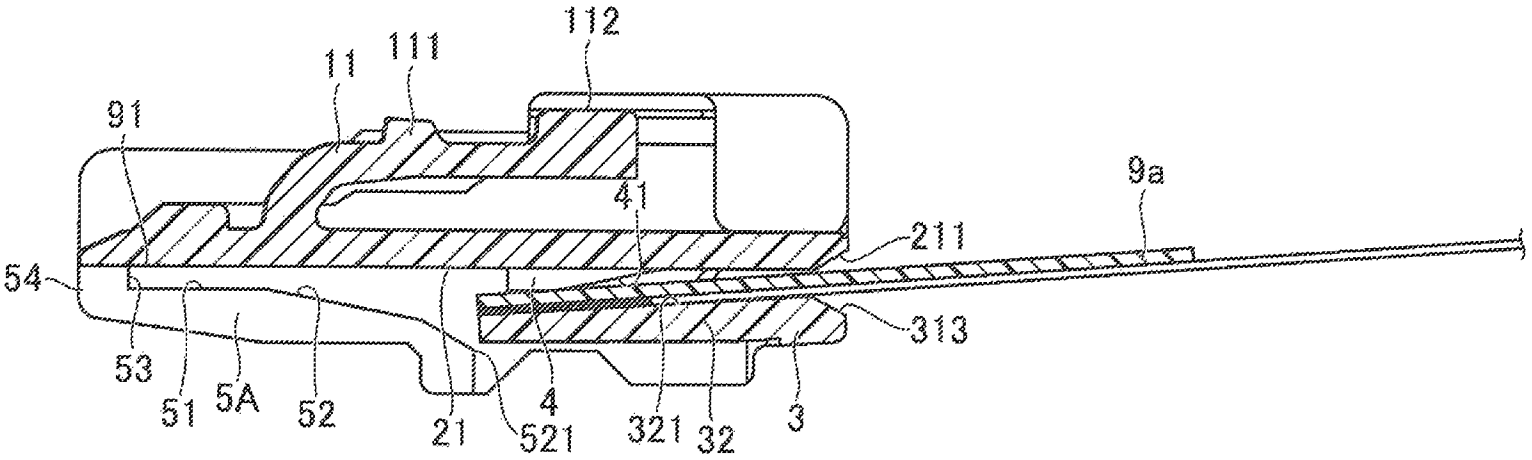
FIG. 5A shows the flat cable being inserted in the cross-sectional view of FIG. 4A.
Figure 5B:
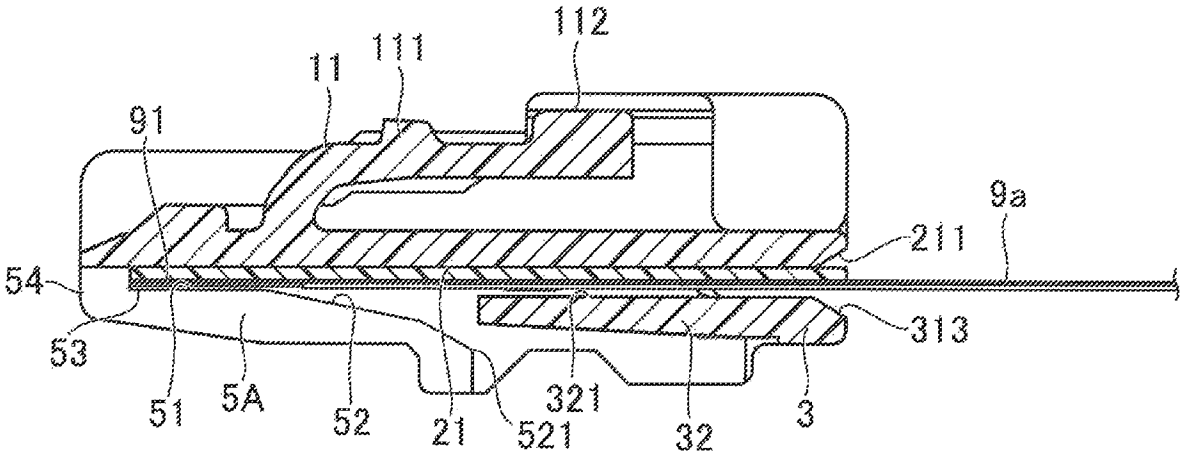
FIG. 5B shows the flat cable after insertion in the cross-sectional view of FIG. 4A.

A first embodiment of the present disclosure will now be explained with reference to FIG. 1 through FIG. 5B. FIG. 1 is a perspective view from above showing the first connector 1*a*, the second connector 6, and the flat cable 9*a* in the first embodiment of the present disclosure. FIG. 2 is a perspective view from below showing the first connector 1*a*, the second connector 6, and the flat cable 9*a* in the same embodiment. FIG. 3 is a bottom view showing the flat cable 9*a* inserted into the first connector 1*a*. FIG. 4A is a cross-sectional view from line IV-IV in FIG. 1. FIG. 4B is an enlarged cross-sectional view of FIG. 4A. FIG. 5A shows the flat cable 9*a* being inserted in the cross-sectional view of FIG. 4A. FIG. 5B shows the flat cable 9*a* after insertion in the cross-sectional view of FIG. 4A. In the following explanation, the directions indicated by X1 and X2 in each drawing denote, respectively, the forward and rearward directions. The directions indicated by Y1 and Y2 in each drawing denote, respectively, the leftward and rightward directions. Also, the directions indicated by Z1 and Z2 in each drawing denote, respectively, the upward and downward directions.

The first connector 1*a* in the present embodiment is a connector mounted on the end portion 91 of a flat cable 9*a*. The first connector 1*a* is inserted into a second connector 6 formed in the shape of a rectangular tube to create a single connector assembly. As shown in FIG. 1 and FIG. 2, the operator can insert the flat cable 9*a* along an insertion slot 51 extending to the rear from the front end of the first connector 1*a*. Also, the second connector 6 has an insertion slot S2 opening in the front side and extending in the front-rear direction. The operator can insert the first connector 1*a* mounted on a flat cable 9*a* into the insertion slot S2. Note that, in the present embodiment, the first connector 1 corresponds to the 'connector' of the present disclosure.

As shown in FIG. 2, nails 7 obtained by bending metal plates are mounted near the left and right ends of the second connector 6. The lower end of each nail 7 is a wide flat surface which is parallel to the outer surface on the lower end of the second connector 6. A plurality of terminals 8 made of a conductive material such as metal are inserted into the second connector 6. Each terminal 8 extends in the front-rear direction, and has a section passing through the rear surface of the second connector 6 and into the insertion slot S2 and a section extending downward from the rear end of this section towards the outer surface on the lower end of the second 6. The lower end of this section has a hook shape. The second connector 6 is arranged on a board (not shown). Here, the second connector 6 is fixed to the board by soldering or otherwise bonding the lower surfaces of the nail 7 and the lower ends of the terminals 8. The lower ends of the terminals 8 are bonded to conductive surfaces arranged on the upper surface of the board to establish an electrical connection with the conductive surfaces.

As shown in FIG. 1 through FIG. 3, the first connector 1*a* has a stage 2 with a substantially rectangular profile when viewed from above. As shown in FIG. 1, a plate spring portion 11 is formed on the upper side of the stage 2 (the surface on the opposite side of the arrangement surface 21) to mate with the second connector 6. The plate spring portion 11 has a plate-like section extending forward from a section connected to the upper surface of the stage 2 and extending upward, and a pressed surface 112 arranged on the upper side of the plate spring portion 11 on the front end of the plate spring portion 11. The pressed surface 112 has a substantially rectangular profile when viewed from above and is connected on the lower side to a plate spring portion 11. An engaging portion 111 is formed to the rear of the pressed surface 112 and protrudes upward from the upper surface of the plate spring portion 11.

In the second connector 6, a wall portion is formed which surrounds the insertion slot S2 above and below, to the left and right, and to the rear, and a projecting portion 612 is formed in the middle position of the upper side of the wall portion 61 in the left-right direction which projects forward from the front surface 611 of the upper side of the wall portion 61. As shown in FIG. 2, an edge portion 614 is formed on the lower surface of the projecting portion 612 which surrounds a rectangular indentation 613 in the center and projects downward. When the first connector 1*a* is inserted into the second connector 6, the engaging portion 111 on the first connector 1*a* is fitted into the indentation 613 in the projecting portion 612 and engages the rear surface of the edge portion 614. In this way, the first connector 1*a* inserted into the second connector 6 is kept from becoming detached. Because the plate spring portion 11 with an engaging portion 111 is elastically deformable in the downward direction, the operator can easily push the pressed surface 112 downward to disengage the edge portion 614 of the second connector 6 from the engaging portion 111 and remove the first connector 1*a*.

Also, guard portions 12 are formed to the left and right of the plate spring portion 11 on the rear side to interpose the plate spring portion 11. These are angular columns which project upward. When the first connector 1*a* is being inserted, the rear surface of the guard portions 12 come into contact with the front surface 611 of the upper side wall portion 61 constituting the second connector 6. This prevents over insertion of the first connector 1*a* into the second connector 6. Also, the upper surfaces of the guard portions 12 are arranged above the pressed surface 112 formed in the plate spring portion 11. When the operator inserts the first connector 1*a*, the operator places a finger on the upper surface of the guard portions 12 and not on the pressed surface 112. When the engaging portion 111 engages the edge portion 614, the upper surface of the engaging portion 111 is pushed down by the lower surface of the edge portion 614, the plate spring portion 11 bends downward. When the engaging portion 111 overcomes the edge portion 614, the plate spring portion 11 moves upward elastically and strikes the lower surface of the edge portion 614. The sound and vibration generated at this time lets the operator know that the first connector 1*a* has been inserted in the proper position inside the second connector 6.

As shown in FIG. 1 and FIG. 2, the stage 2 includes two side wall portions 10 positioned on opposite sides in the left-right direction to interpose the arrangement surface 21 (more specifically, a left side wall portion 10A constituting the left end of the first connector 1*a* and a right side wall portion 10B constituting the right end of the first connector 1*a*). Side wall portion 10A and side wall portion 10B are formed so as to have the same shape and left-right symmetry on the first connector 1*a*. Also, as shown in FIG. 1, the left and right side wall portions 10A, 10B have an upper wall portion 14 with an overhang facing inward. The upper wall portions 14 are formed above the stage 2. Also, as shown in FIG. 3, the guide portions 5A, 5B described later are formed on the lower side of the arrangement surface 21. The left and right side wall portions 10A, 10B and the guide portions 5A, 5B have rectangular lower wall portions 54 on the rear end. The lateral width of the lower wall portion 54 in the left-right direction is greater than the lateral width of the upper wall portion 14 in the left-right direction.

The insertion slot S2 provided inside the second connector 6 has an upper space 65 which is rectangular and columnar for accommodating the upper wall portion, and a lower space 66 which is rectangular and columnar for accommodating the lower wall portion 54. The lateral width of the upper space 65 in the left-right direction is somewhat greater than the lateral width of the upper wall portion 14 and smaller than the lateral width of the lower wall portion 54. As a result, insertion of the first connector 1*a* into the second connector 6 is prevented when the first connector 1*a* is inserted upside down or backwards.

As shown in FIG. 2, a plurality of conductive surfaces 95 made of a conductive material such as metal are formed on the lower side of the end portion 91 of the flat cable 9*a*. These conductive surface 95 are arranged in a single row on the rear end of the flat cable 9*a* in the left-right direction. Wiring (not shown) is connected to each one of the conductive surfaces 95, and the wiring establishes an electrical connection between the end portion 91 of the flat cable 9*a* and the conductive surfaces formed in the end portion on the opposite side of the cable. When the first connector 1 and the flat cable 9*a* have been inserted into the second conductor 6, the conductive surface 95 comes into contact with the terminals 8 inserted into the second connector 6 and an electrical connection is established. The flat cable 9*a* has a reinforcing plate 92 made of resin. The reinforcing plate 92 overlaps with the upper surface of the end portion 91 of the flat cable 9*a* and has the same profile as the end portion 91 when viewed from above. When a reinforcing plate 92 is provided on the end portion 91 of the flat cable 9*a*, bending of the end portion 91 can be prevented. Engaging protruding portions 4A, 4B described later are formed in the first connector 1*a* to engage the end portion of the flat cable 9*a*, and the flat cable 9*a* includes an engaged portion which prevents detachment. For example, as shown in FIG. 2, the flat cable 9*a* has a constricted portion U whose lateral width in the left-right direction is smaller than the lateral width of the other sections. A rear edge portion 93 is formed on the rear side of the constricted portion U which extends in the left-right direction, and the rear edge portion 93 functions as the engaged portion for engaging the engaging protruding portions 4A, 4B of the first connector 1*a*. A front edge portion 94 is formed on the front side of the constricted portion U which extends in an oblique direction towards the front of the flat cable 9*a*. The flat cable 9*a* is narrowest at lateral width u2 in the left-right direction of the constricted portion U, and lateral width u3 at the front side of the constricted portion U is wider than lateral width u1 of the end portion 91.

An arrangement surface 21 is provided on the lower side of the stage 2 which is a flat lower surface with a rectangular profile on which the end portion 91 of the flat cable 9*a* is arranged. The side wall portions 10 formed on the left end and the right end of the stage 2 each have an inner surface 101 extending downward from the section making contact with the arrangement surface 21. The inner surfaces 101 of the two side wall portions 10A, 10B face each other via the arrangement surface 21. As shown in FIG. 3, the lateral width of the arrangement surface 21 in the left-right direction (that is, the distance between the inner surfaces 101 of the side wall portions 10A, 10B) is somewhat wider than the lateral width of the end portion 91 of the flat cable 9*a* in the left-right direction. As a result, the end portion 91 of the flat cable 9*a* inserted into the insertion slot S1 comes into contact with the inner surfaces 101 of the side wall portions 10 and is guided over the arrangement surface 21 without any deviation in the left-right direction.

As shown in FIG. 3, the arrangement surface 21 includes an engaging protruding portion 4A arranged on the left end of the arrangement surface 21 and an engaging protruding portion 4B arranged on the right end of the arrangement surface 21 which serve as engaging protruding portions 4 for engaging the rear edge portion 93 of the flat cable 9*a*. The engaging protruding portions 4A, 4B have a rectangular profile when viewed from above and are parallel to each other in the left-right direction. As shown in FIG. 3 and FIG. 4A, each engaging protruding portion 4 has an inclined surface 41 inclined to the rear and downward obliquely from the arrangement surface 21, a rear surface 42 on the side opposite the inclined surface 41 extending downward and in the left-right direction from the arrangement surface 21, and a lower surface 43 connected to the inclined surface 41 and to the lower end of the rear surface 42 and facing downward (that is, away from the arrangement surface 21). Because the engaging protruding portions 4 have an inclined surface 41, the end portion 91 of the flat cable 9*a* can overcome the engaging protruding portions 4 via the inclined surfaces 41, and the flat cable 9*a* can be easily inserted. However, because the rear surfaces 42 of the engaging protruding portions 4 oppose the rear edge portions 93 formed on the left and right ends of the flat cable 9*a*, the flat cable 9*a* is kept from becoming detached. Because engaging protruding portion 4A and engaging protruding portion 4B are provided on the left and right ends of the arrangement surface 21, a rear edge portion 93 can be provided on the flat cable 9*a* which engages the engaging protruding portions 4 at a position away from the central section where the wiring (not shown) connected to the conductive surfaces 95 is arranged (for example, on the left and right end portions of the flat cable 9*a*).

An opposing portion 3 is formed on the lower end of the stage 2 which faces the arrangement surface 21 and forms a gap with respect to the arrangement surface 21. The operator can insert the flat cable 9*a* between the stage 2 and the opposing portion 3. The opposing portion 3 is positioned below the flat cable 9*a* when it has been inserted blow the arrangement surface 21. The opposing portion 3 has an extending portion 31 extending in the left-right direction below and in front of the engaging protruding portions 4A, 4B, and an overhanging portion 32 extending to the rear from the extending portion 31. The extending portion 31 has a connecting portion 311A connected to the front surface 102A of the left side wall portion 10A, a connecting portion 311B connected to the front surface 102B of the right side wall portion 10B, and a front edge portion 312 positioned in front of the connecting portions 311A, 311B. In the present embodiment, connecting portion 311A and connecting portion 311B are arranged parallel to each other in the left-right direction. The extending portion 31 spans both side wall portions 10A, 10B via the connecting portions 311A, 311B, and is fixed to the front surface of the side wall portions 10A, 10B. In the present embodiment, the extending portion 31 corresponds to the 'first section' of the present disclosure and the overhanging portion 32 corresponds to the 'second section' of the present disclosure.

As shown in FIG. 2 and FIG. 3, the overhanging portion 32 is a narrow plate-like portion which has a lateral width in the left-right direction that is smaller than that of the extending portion 31, and which extends to the rear along the arrangement surface 21 from the central portion of the extending portion 31 in the left-right direction. The overhanging portion 32 extends to the rear of the connecting portions 311A, 311B, and the thickness in the up-down direction and the lateral width in the left-right direction become smaller moving from the front end to the rear end. The overhanging portion 32 is positioned between the engaging protruding portion 4A provided on the left end of the arrangement surface 21 and the engaging protruding portion 4B provided on the right end of the arrangement surface 21. While the flat cable 9*a* is being inserted, the end portion 91 of the flat cable 9*a* is supported from below by the overhanging portion 32. This keeps the end portion 91 of the flat cable 9*a* from becoming separated from the arrangement surface 21 from below and keeps the flat cable 9*a* from becoming detached. In other words, by forming an overhanging portion 32 in the first connector 1*a*, the mounting stability of the flat cable 9*a* in the first connector 1*a* can be improved.

As shown in FIG. 4B, the overhanging portion 32 has an upper surface 321 when the first connector 1*a* is viewed in cross-section which faces the arrangement surface 21 and the lower surfaces of the engaging protruding portions 4. Here, the height (s1) from the lower surfaces 43 of the engaging protruding portions 4 to the arrangement surface 21 is greater than the distance (s2) from the lower surfaces 43 to the upper surface 321 of the overhanging portion 32. In this way, the thickness of the end portion 91 of the flat cable 9*a* in the up-down direction can be greater than the distance s2 from the lower surfaces 43 of the engaging protruding portions 4 to the upper surface 321 of the overhanging portion 32, and the end portion 91 of the flat cable 9*a* engaged by the engaging protruding portions 4 are more difficult to detach. The rear end 322 of the overhanging portion 32 is positioned to the rear of the rear surface 42 of the engaging protruding portions 4. Therefore, the rear end 322 of the overhanging portion 32 covers the rear side of the flat cable 9*a* from the rear edge portion 93 of the flat cable 9*a* inserted into the first connector 1*a* (that is, the section engaging the engaging protruding portions 4). This makes it less likely that the flat cable 9*a* inserted into the first connector 1*a* will become detached. In the present embodiment, the lower surfaces 43 of the engaging protruding portions 4 correspond to the 'first surface' of the present disclosure and the upper surface 321 of the overhanging portion 32 corresponds to the 'second surface' of the present disclosure.

Also, as shown in FIG. 3 and FIG. 4A, the opposing portion 3 is elastically deformable so that the overhanging portion 32 moves in the up-down direction around the connecting portions 311A, 311B. The opposing portion 3, for example, can be elastically deformable so as to move from the reference orientation W1 at which a flat cable 9*a* has not been inserted, to a pressed down orientation W2 at which the overhanging portion 32 has been pressed down, and then to a raised up orientation W3 at which the overhanging portion 32 has been raised up. When the overhanging portion 32 is in the pressed down orientation W2, the distance between the overhanging portion 32 and the arrangement surface 21 is greater than the distance in the reference orientation W1. When the overhanging portion 32 is in the raised up orientation W3, the distance between the overhanging portion 32 and the arrangement surface 21 is smaller than the distance in the reference orientation W1. Because the opposing portion 3 is elastically deformable with the two connecting portions 311A, 311B serving as the fulcrums, the overhanging portion 32 can be inclined upward and downward around the central point T between the two connecting portions 311A, 311B.

As shown in FIG. 5A, which is one example of the insertion process for a flat cable 9*a*, the overhanging portion 32 is pressed down by the end portion 91 of the flat cable 9*a* and moves downward. In this way, the space into which the flat cable 9*a* is inserted can be maintained between the upper surface 321 of the overhanging portion 32 and the lower surfaces 43 of the engaging protruding portions 4.

Alternatively, the deflection of the end portion 91 of the flat cable 9*a* can be utilized to insert the flat cable 9*a* without deforming the overhanging portion 32. In other words, when the central portion in the left-right direction is bulging in the end portion 91 of the flat cable 9*a* relative to the left and right end, the rear edge portion 93 formed on the left and right ends of the flat cable 9*a* can overcome the inclined surfaces 41 of the engaging protruding portions 4A, 4B formed on the left and right ends of the arrangement surface 21 without deforming the overhanging portion 32.

The front edge portion 312 of the extending portion 31 constituting the opposing portion 3 can move to the side opposite the overhanging portion 32 around the center point T of the connecting portions 311A, 311B. In other words, when the front edge portion 312 moves away from the arrangement surface 21, the overhanging portion 32 moves closer to the arrangement surface 21. For example, when the flat cable 9*a* mounted in the first connector 1*a* is pulled forward and downward at an oblique angle, the front edge portion 312 is pushed downward by the end portion 91 of the flat cable 9*a* and the overhanging portion 32 moves upward. In this way, the end portion 91 of the flat cable 9*a* is pressed down by the upper surface 321 of the overhanging portion 32 and pushed into the arrangement surface 21. In other words, when the flat cable 9*a* is pulled, the upper surface 321 of the overhanging portion 32 presses against the end portion 91 of the flat cable 9*a*, and the flat cable 9*a* is kept from becoming detached from the first connector 1*a*.

As shown in FIG. 2 and FIG. 4B, a groove portion 13 is formed in the front surface of each side wall portion 10A, 10B. The groove portion 13 is formed between the end portion of the extending portion 31 and the arrangement surface 21 in the up-down direction, and the bottom surface of the groove portion 13 is formed so that the central portion is deeper in the up-down direction. As shown in FIG. 4B, the bottom surface of the groove portion 13 extends obliquely leftward (or rightward) and forward, and the bottom surface 131 inside the groove portion 13 making contact with the inner surface 101 of each side wall portion 10 is positioned to the rear of the outer bottom surface 132 making contact with the outer surface of the side wall portions 10. As shown in FIG. 3, the front edge portion 94 of the flat cable 9*a* is arranged in front of the groove portion 13. When the flat cable 9*a* is inserted, the front edge portion 94 of the flat cable 9*a* is pushed rightward (or leftward) along the obliquely formed groove portion 13. As a result, the end portion 91 of the flat cable 9*a* is inserted downward on the arrangement surface 21 without deviation in the left-right direction.

As shown in FIG. 2 and FIG. 4B, guide portions 5 are formed on the lower side of the arrangement surface 21 to guide the flat cable 9*a* downward on the arrangement surface 21. A guide portion 5A is formed to the rear of the engaging protruding portion 4A on the left side (more specifically, in the left rear corner of the arrangement surface 21) and a guide portion 5B is formed to the rear of the engaging protruding portion 4B on the right side (more specifically, in the right rear corner of the arrangement surface 21). As shown in FIG. 3, the guide portions 5A, 5B have a rectangular profile when viewed from above and are arranged parallel to each other in the left-right direction.

As shown in FIG. 4A, the guide portions 5 are formed so as to face the arrangement surface 21. More specifically, the guide portions 5 have an upper surface 51 extending along the arrangement surface 21 and facing the arrangement surface 21, an inclined surface 52 extending obliquely forward and downward from the front end of the upper surface 51, and a rear surface 53 rising upward at the rear end of the upper surface 51. The distance between the arrangement surface 21 and the upper surface 51 of the guide portions 5 is somewhat wider than the thickness of the end portion 91 of the flat cable 9*a* in the up-down direction. As shown in FIG. 5B, the edge on the rear end of the flat cable 9*a* is arranged between the arrangement surface 21 and the upper surface 51 of the guide portions 5 when the end portion 91 of the flat cable 9*a* has been inserted into the proper insertion position below the arrangement surface 21.

As shown in FIG. 4A and FIG. 4B, the distance (s1+s2) between the arrangement surface 21 and the upper surface 321 of the overhanging portion 32 is greater than the distance (s3) between the arrangement surface 21 and the upper surface 51 of the guide portions 5. By widening the entrance to the insertion slot S1 for insertion of the end portion 91 of the flat cable 9*a* in this manner, the end portion 91 can be easily inserted. An inclined surface 211 is formed on the front end of the arrangement surface 21 which extends obliquely forward and upward, and an inclined surface 313 is formed in the extending portion 31 constituting the front end of the opposing portion 3 which extends obliquely forward and downward. In this way, the height (s4) in the up-down direction of the entrance for insertion of the flat cable 9*a* can be greater than the distance (s1+s2) between the arrangement surface 21 and the upper surface 321 of the overhanging portion 32, and the end portion 91 of the flat cable 9*a* can be more easily inserted.

As shown in FIG. 5A and FIG. 5B, the end portion 91 of the flat cable 9*a* can be inserted along the insertion slot S1 from the front end to the rear end of the first connector 1*a* between the arrangement surface 21 and the opposing portion 3. While the flat cable 9*a* is being inserted, the end portion 91 of the flat cable 9*a* overcomes the engaging protruding portions 4 and the rear end side of the flat cable 9*a* tilts downward. Here, the overhanging portion 31 is pressed down by the end portion 91 of the flat cable 9*a* and moves downward. However, because of the force acting to elastically return the overhanging portion 32 to the reference orientation W1, the end portion 91 of the flat cable 9*a* is biased from a downward to a horizontal orientation. Also, the distance (s5) between the arrangement surface 21 and the front end portion 521 of the inclined surface 52 in the up-down direction is greater than the height (s1) from the lower surfaces 43 of the engaging protruding portions 4 to the arrangement surface 21 and the distance (s1+s2) between the arrangement surface 21 and the upper surface 321 of the overhanging portion 32. As a result, even when the end portion 91 of the flat cable 9*a* temporarily advances into the first connector 1*a* while inclined downward, the edge on the rear end of the flat cable 9*a* presses upwards against the inclined surfaces 52 of the guide portions 5 and is arranged above the upper surface 51 of the guide portions 5. Also, the end portion 91 of the flat cable 9*a* makes contact with the rear surfaces 53 of the guide portions 5 to prevent insertion of the end portion 91 of the flat cable 9*a* farther rearward beyond the proper insertion position (see FIG. 5B).

As mentioned above, the first connector 1*a* in the present embodiment has a unique overhanging portion 32 below the arrangement surface 21 which extends in the front-rear direction along the arrangement surface 21. The overhanging portion 32 supports the rear portion 91 of the flat cable 9*a* from below and prevents detachment of the flat cable 9*a*. As a result, the mounting stability of the flat cable 9*a* in the first connector 1*a* can be improved.

Figure 6:
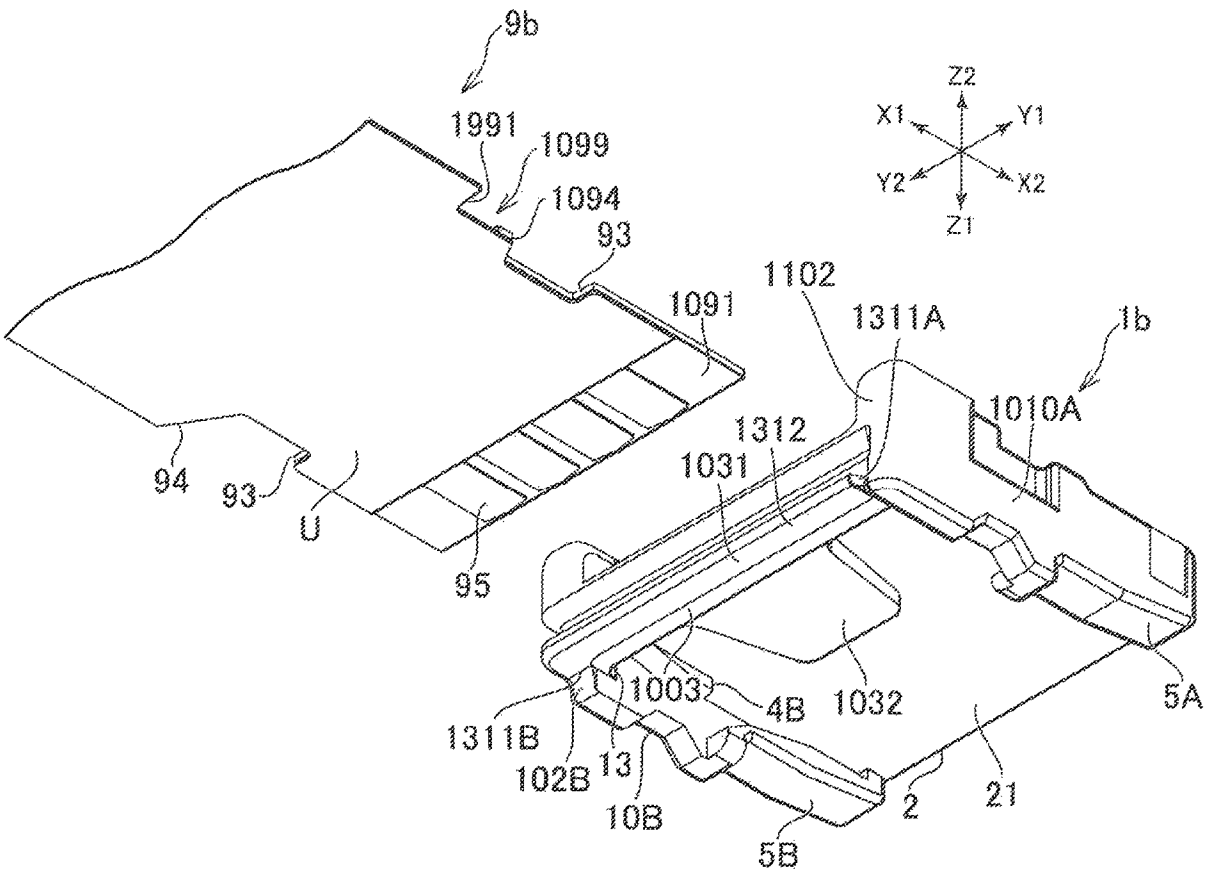
FIG. 6 is a perspective view from below of the first connector and the flat cable in the second embodiment of the present disclosure.

A second embodiment of the present disclosure will now be explained with reference to FIG. 6. FIG. 6 is a perspective view from below of the first connector 1*b* and the flat cable 9*b* in the second embodiment of the present disclosure. The first connector 1*b* can be inserted into the second connector 6 explained in the first embodiment with a flat cable 9*b* attached. In FIG. 6, the components identical to those in the first embodiment are denoted by the same reference numbers. In the following, only elements different from those in the first embodiment will be explained. The items in the second embodiment that remain unexplained are identical to those in the first embodiment.

The first connector 1*b* differs from the first connector 1*a* explained in the first embodiment in that it has left-right asymmetry. The flat cable 9*b* is also formed with left-right asymmetry so as to conform to the shape of the first connector 1*b*. Because the first connector 1*b* and the flat cable 9*b* have left-right asymmetry, the flat cable 9*b* cannot be inserted into the first connector 1*b* upside down.

A side wall portion 1010A and side wall portion 10B with different shapes are formed on the left end and the right end of the first connector 1*b*. A side wall portion 10B including a groove portion 13 is formed on the right end of the first connector 1*b* in the same manner as the first connector 1*a* explained in the first embodiment. However, a groove portion 13 is not formed in the side wall portion 1010A formed in the left side (Y1 side) of the first connector 1*b*. In other words, the left end surface and inner surface of the side wall portion 1010A and the front surface 1102 widen to fill the groove portion 13 and the notch on the upper side thereof.

A notch 1099 cut with a rectangular profile is formed in the end of the front edge portion 1094 extending obliquely on the left side of the flat cable 9*b* (that is, leftward in the constricted portion U which has the narrowest width in the left-right direction). Because a notch 1099 is provided in the left end of the flat cable 9*b*, the flat cable 9*b* does not strike the side wall portion 101A on the left side when inserted. The edge 1991 on the front side of the notch 1099 is arranged so as to face the front surface 1102 of the side wall portion 1010A in the front-rear direction when the flat cable 9*b* is inserted into the first connector 1*b*.

An opposing portion 1003 is formed in the first connector 1*b* so as to be arranged below the arrangement surface 21, and an extending portion 1031 extending in the left-right direction on the front side thereof has a left side connecting portion 1311A, a right side connecting portion 1311B, and a front edge portion 1312 connected to the two connecting portions. The left and right connecting portions 1311A, 1311B are formed in front of the left and right side wall portions 1010A, 10B. The right side connecting portion 1311B, as in the case of the connecting portion 311B explained in the first embodiment, extends in the front surface 102B of the right side wall portion 10B in the left-right direction. The left side connecting portion 1311A is positioned on the right side surface of the left side wall portion 1010A and extends to the rear from the front surface 1102. The front surface 1102 of the left side wall portion 1010A is positioned in front of the front surface 102B of the right side wall portion 10B, and the left side connecting portion 1311A is positioned in front of the left side connecting portion 1311B. The extending portion 1031 is secured to the front surface 102B of the right side wall portion 10B, and to the front surface 1102 and the right side surface of the left side wall portion 1010A.

The overhanging portion 1032, as in the first embodiment, faces the rear of the extending portion 103 and extends in the horizontal direction with respect to the arrangement surface 21. When the flat cable 9*b* is inserted, the overhanging portion 1032 supports the end portion 1091 of the flat cable 9*b* from below. This keeps the flat cable 9*b* from becoming detached while being inserted, and can improve the mounting stability of the flat cable 9*b* inside the first connector 1*b*.

Also, as in the first embodiment, the opposing portion 1003 is elastically deformable, and the overhanging portion 1032 moves in the up-down direction around the connecting portions 1311A, 1311B. The overhanging portion 1032 tilts downward when pressed down by the end portion 1091 of the flat cable 9*b*. In this way, space can be maintained for insertion of the flat cable 9*b*. Also, when the flat cable 9*b* inserted into the first connector 1*b* is pulled, the front edge portion 1312 moves downward, the overhanging portion 1032 moves upward near the arrangement surface 21, and the end portion 1091 of the flat cable 9*b* is pressed against the arrangement surface 21. This keeps the flat cable 9*b* from becoming detached from the first connector 1*b*. The front edge portion 1312 is connected to the front surface of the side wall portion 10B on the right end and connected to the inner surface of the side wall portion 1010A on the right end. As a result, the opposing portion 1003 becomes elastically deformed and the overhanging portion 1032 tilts obliquely relative to the left-right horizontal direction. More specifically, the moving distance in the up-down direction on the left side of the overhanging portion 1032 when the opposing portion 1003 is elastically deformed is greater than the moving distance on the right side of the overhanging portion 1032.

The present disclosure is not limited to the embodiments explained above and various changes are possible. For example, in the first embodiment, the extending portion 31 extends in the left-right direction and spans the left and right side wall portions 10A, 10B. However, the extending portion 31 does not have to span the side wall portions 10A, 10B. For example, the extending portion 31 may be severed at the mid-point in the left-right direction, and the overhanging portion 32 may extend to the rear from the end portions of the severed extending portion 31. Also, the extending portion 31 does not have to have two connecting portions, that is, left and right connecting portions 311A, 311B. It may have either connecting portion 311A or 311B, and may extend from there to the right or left.

In the first embodiment, the rear surfaces 42 of the engaging protruding portions 4 are formed in front of the rear end 322 of the overhanging portion 32. However, the rear surfaces 42 of the engaging protruding portions 4 may be formed to the rear of the rear end 322 of the overhanging portion 32. Also, the engaging protruding portions 4 may be formed to the rear in the front-rear direction so as not to overlap with the overhanging portion 32. Also, the engaging protruding portions 4 do not have to be arranged on the left and right ends of the arrangement surface 21 but may be arranged in the center of the arrangement surface 21 in the left-right direction.

The disclosures in the present specification are merely examples of the present disclosure. A person skilled in the art could easily make modifications while preserving the essentials of the present disclosure, and these modifications fall within the scope of the claims. The width, thickness, and shape of each component in the drawings are schematic illustrations and do not limit the interpretation of the present disclosure.

The invention claimed is:

1. A connector configured to be mounted on an end portion of a flat cable, the connector comprising:

a stage having an arrangement surface for arranging the end portion of the flat cable;

an engaging protruding portion formed on the arrangement surface for engaging the flat cable;

an opposing portion formed so as to face the arrangement surface; and two side wall portions positioned on opposite sides from each other in the left-right direction to interpose the arrangement surface, wherein the end portion of the flat cable is insertable from a front side of the connector to a rear side of the connector between the arrangement surface and the opposing portion, wherein the opposing portion has a first section arranged in front of the engaging protruding portion and a second section extending rearward from the first section, wherein the first section has a connecting portion connecting to at least one of the two side wall portions, and wherein the opposing portion is elastically deformable to allow the second section to move vertically around the connecting portion.

2. A connector configured to receive and secure an end portion of a flat cable, the connector comprising:

a stage having a substantially rectangular profile, the stage having front and rear ends, left and right side ends, and upper and lower surfaces;

left and right side wall portions, the stage extending between the left and right side wall portions with the left side end of the stage being connected to the left side wall portion and the right side end of the stage being connected to the right side wall portion, each of the left and right side wall portions have inner surfaces which face each other and which extend downward from the connection with the left and right side ends of the stage, each of the left and right side wall portions having front surfaces;

left and right side engaging protruding portions, the left side engaging protruding portion extending downwardly from the lower surface of the stage proximate to the connection of the left side wall portion and the left side end of the stage, the right side engaging protruding portion extending downwardly from the lower surface of the stage proximate to the connection of the right side wall portion and the right side end of the stage; and an opposing portion having an extending portion and an overhanging portion, the extending portion being connected to the front surfaces of the left and right side wall portions and extending between the left and right side wall portions, the extending portion being positioned forward of the left and right side engaging protruding portions, the extending portion being positioned below the lower surface of the stage, thereby defining an insertion slot between the lower surface of the stage, the left and right side wall portions and the opposing portion, the insertion slot defining an opening at the front end of the stage, the overhanging portion extending rearwardly from the extending portion, wherein the opening of the insertion slot is configured to receive the end portion of the flat cable, thereby allowing the flat cable to be positioned within the insertion slot and secured to the connector.

3. The connector as defined in claim 2, further comprising a plate spring portion formed on the upper surface of the stage, the plate spring portion having a pressed surface arranged on an upper side of the plate spring portion at a front end thereof, the plate spring portion having an engaging portion formed to the rear of the pressed surface, the engaging portion protruding upwardly from the upper side of the plate spring portion.

4. The connector as defined in claim 3, further comprising left and right side guard portions, the left and right side guard portions extending upwardly from the upper surface of the stage, the plate spring portion being positioned between the left and right side guard portions, the left and right side guard portions each having an upper surface which is positioned above the pressed surface of the plate spring portion.

5. The connector as defined in claim 2, wherein each engaging portion is configured to engage the end portion of the flat cable, each engaging portion having an inclined surface, a rear surface and a lower surface, the inclined surface being inclined to the rear and downward obliquely from the lower surface of the stage, the rear surface extending downward and in a left-right direction from the lower surface of the stage, the lower surface being connected to the inclined surface and the rear surface and facing downward.

6. The connector as defined in claim 5, wherein a first distance is defined from the lower surface of each engaging portion to the lower surface of the stage, and wherein a second distance is defined from the lower surface of each engaging portion to an upper surface of the overhanging portion of the opposing portion, wherein the first distance is greater than the second distance.

7. The connector as defined in claim 6, further comprising left and right side guide portions formed on the lower surface of the stage, the left and right side guide portions configured to guide the flat cable toward the lower surface of the stage, the left side guide portion being provided to the rear of the left side engaging protruding portion, the right side guide portion being provided to the rear of the right side engaging protruding portion.

8. The connector as defined in claim 7, wherein each guide portion has an upper surface, an inclined surface and a rear surface, the upper surface extending along, but separated from, the lower surface of the stage and facing the lower surface of the stage, the inclined surface extending obliquely forward and downward from a front end of the upper surface of the guide portion, the rear surface rising upward at a rear end of the upper surface of the guide portion.

9. The connector as defined in claim 8, wherein a third distance is defined between the lower surface of the stage and the upper surface of each guide portion, wherein the first distance plus the second distance is greater than the third distance.

10. The connector as defined in claim 2, wherein the extending portion of the opposing portion has left and right side connecting portions and a front edge portion, the left side connecting portion being connected to the front surface of the left side wall portion, the right side connecting portion being connected to the front surface of the right side wall portion, the front edge portion being positioned forward of the left and right side connecting portions.

11. The connector as defined in claim 10, wherein the overhanging portion of the opposing portion is a narrow plate-like portion which has a lateral width in a left-right direction that is smaller than a lateral width of the extending portion, the overhanging portion extending to a rear of the left and right side connecting portions.

12. The connector as defined in claim 10, wherein the overhanging portion is elastically deformable with the left and right side connecting portions serving as fulcrums, thereby allowing the overhanging portion to be movable in an up-down direction.

13. The connector as defined in claim 1, wherein the overhanging portion of the opposing portion is a narrow plate-like portion which has a lateral width in a left-right direction that is smaller than a lateral width of the extending portion.

14. The connector as defined in claim 1, wherein the overhanging portion has a thickness in an up-down direction that decreases from a front end thereof to a rear end thereof.

15. The connector as defined in claim 2, wherein the overhanging portion is elastically deformable, thereby allowing the overhanging portion to be movable in an up-down direction.

16. The connector as defined in claim 2, further comprising left and right side guide portions formed on the lower surface of the stage, the left and right side guide portions configured to guide the flat cable toward the lower surface of the stage, the left side guide portion being provided to the rear of the left side engaging protruding portion, the right side guide portion being provided to the rear of the right side engaging protruding portion.

17. The connector as defined in claim 16, wherein each guide portion has an upper surface, an inclined surface and a rear surface, the upper surface extending along, but separated from, the lower surface of the stage and facing the lower surface of the stage, the inclined surface extending obliquely forward and downward from a front end of the upper surface of the guide portion, the rear surface rising upward at a rear end of the upper surface of the guide portion.

18. A connector assembly comprising:

a first connector having a front end portion and a rear end portion, the first connector being configured to receive and secure an end portion of a flat cable via a first insertion slot provided at the front end portion of the first connector, the end portion of the flat cable having a plurality of conductive surfaces formed on a lower surface thereof; and a second connector having a front end portion, the second connector having a plurality of terminals, the second connector being configured to receive and secure the rear end portion of the first connector via a second insertion slot provided at the front end portion of the second connector, the plurality of terminals being configured to electrically connect to the plurality of conductive surfaces formed on the lower surface of the end portion of the flat cable when the first and second connectors are secured to one another, wherein the first connector comprises:

a stage having a substantially rectangular profile, the stage having front and rear ends, left and right side ends, and upper and lower surfaces;

left and right side wall portions, the stage extending between the left and right side wall portions with the left side end of the stage being connected to the left side wall portion and the right side end of the stage being connected to the right side wall portion, each of the left and right side wall portions have inner surfaces which face each other and which extend downward from the connection with the left and right side ends of the stage, each of the left and right side wall portions having front surfaces;

left and right side engaging protruding portions, the left side engaging protruding portion extending downwardly from the lower surface of the stage proximate to the connection of the left side wall portion and the left side end of the stage, the right side engaging protruding portion extending downwardly from the lower surface of the stage proximate to the connection of the right side wall portion and the right side end of the stage; and an opposing portion having an extending portion and an overhanging portion, the extending portion being connected to the front surfaces of the left and right side wall portions and extending between the left and right side wall portions, the extending portion being positioned forward of the left and right side engaging protruding portions, the extending portion being positioned below the lower surface of the stage, thereby defining the first insertion slot between the lower surface of the stage, the left and right side wall portions and the opposing portion, the first insertion slot defining an opening at the front end of the stage, the overhanging portion extending rearwardly from the extending portion, wherein the opening of the first insertion slot is configured to receive the end portion of the flat cable, thereby allowing the flat cable to be positioned within the first insertion slot and secured to the first connector.

* * * * *